US007017745B2

(12) United States Patent
Raghunathan

(10) Patent No.: US 7,017,745 B2
(45) Date of Patent: Mar. 28, 2006

(54) MULTI-LEVEL STACKING CONTAINER

(75) Inventor: Narayan Raghunathan, Mississauga (CA)

(73) Assignee: Norseman Plastics, Limited, (CA)

( * ) Notice: Subject to any disclaimer, the term of this patent is extended or adjusted under 35 U.S.C. 154(b) by 0 days.

(21) Appl. No.: 10/457,398

(22) Filed: Jun. 10, 2003

(65) Prior Publication Data

US 2004/0245142 A1 Dec. 9, 2004

Related U.S. Application Data

(63) Continuation-in-part of application No. 10/045,035, filed on Jan. 15, 2002.

(60) Provisional application No. 60/261,201, filed on Jan. 16, 2001.

(30) Foreign Application Priority Data

Jan. 15, 2001 (CA) ..... 2331202
Jun. 9, 2003 (CA) ..... 2431444

(51) Int. Cl.
*B65D 21/032* (2006.01)

(52) U.S. Cl. ..... 206/506

(58) Field of Classification Search ..... 206/503, 206/505, 506
See application file for complete search history.

(56) References Cited

U.S. PATENT DOCUMENTS 2,026,204 A 12/1935 Andrews (Continued)

FOREIGN PATENT DOCUMENTS

EP 0 370 771 A2 5/1990

(Continued)

*Primary Examiner*—Stephen Castellano
(74) *Attorney, Agent, or Firm*—Katten Muchin Rosenman, LLP

(57) ABSTRACT

The present invention provides a container comprising a base configured to vertically support at least one object, a pair of opposed sidewalls projecting above the base and configured to retain the at least one vertically supported object on the base, each of the sidewalls having a top surface, an exterior surface, and a receptacle, wherein the exterior surface merges with the top surface to define an upper exterior edge, and wherein the exterior surface further merges with the receptacle to define a receptacle edge, and a support member pivotally mounted within the receptacles to facilitate pivotal movement of the support member relative to each of the sidewalls, the support member being configured to support a second identical container, wherein the upper exterior edge and the receptacle edge of at least one of the opposed sidewalls are configured to simultaneously oppose the support member during at least a portion of the pivotal movement such that the clearance between the support member and the upper edge is greater than the clearance between the support member and the receptacle.

The present invention provides a container comprising a base configured to vertically support at least one object, a pair of opposed sidewalls and a pair of opposed endwalls, each of the sidewalls and the endwalls projecting above the base and configured to retain the at least one vertically supported object on the base, each of the sidewalls having an exterior surface defining a receptacle, and a support member pivotally mounted within the receptacles to facilitate pivotal movement of the support member relative to each of the sidewalls, the support member configured to support a second identical container, wherein at least one of the endwalls includes a support surface configured to support the support member, the support surface including at least two notches configured to permit application of a force to the support member by fingers of a human hand when the support member is resting on the support surfaces such that the application of the force displaces the support member from the support surface.

21 Claims, 6 Drawing Sheets

U.S. PATENT DOCUMENTS

| | | | | |
|---|---|---|---|---|
| 2,029,746 | A | 2/1936 | Tufts et al. | |
| 2,061,414 | A | 11/1936 | Tufts et al. | |
| 2,641,383 | A | 6/1953 | Coursey | |
| 3,375,953 | A | 4/1968 | Miller, Jr. | |
| 3,379,339 | A | 4/1968 | Asenbauer | |
| 3,421,656 | A | 1/1969 | Asenbauer | |
| 3,659,743 | A | 5/1972 | Box | |
| 3,752,352 | A | 8/1973 | Senecal | |
| 3,780,905 | A | 12/1973 | Herolzer | |
| 3,951,265 | A | 4/1976 | Carroll | |
| 4,000,817 | A | 1/1977 | Sanders et al. | |
| 4,105,117 | A | 8/1978 | Atkin et al. | |
| 4,106,623 | A | 8/1978 | Carroll et al. | |
| 4,109,791 | A | 8/1978 | Clipson et al. | |
| 4,391,369 | A | 7/1983 | Stahl et al. | |
| 4,573,577 | A | 3/1986 | Miller | |
| 5,287,966 | A | 2/1994 | Stahl | |
| 5,344,022 | A | 9/1994 | Stahl | |
| 5,609,254 | A | 3/1997 | Loftus et al. | |
| 5,881,902 | A | 3/1999 | Ackermann | |
| 2003/0230510 | A1* | 12/2003 | Aiken et al. | 206/506 |

FOREIGN PATENT DOCUMENTS

| | | |
|---|---|---|
| FR | 1131652 | 2/1957 |
| GB | 2 067 167 | 7/1981 |

* cited by examiner

MULTI-LEVEL STACKING CONTAINER

"This application is a continuation-in-part of application Ser. No. 10/045,035, entitled "Multi-Level Stacking Container", and filed Jan. 15, 2002; which claims priority under 35 U.S.C. 119(e) to Provisional Application No. 60/261,201, entitled "Multi-Level Stacking Container", and filed Jan. 16, 2001."

FIELD OF INVENTION

The present invention relates to containers and, more particularly, to containers capable of stacking one upon another at different levels relative one another.

BACKGROUND OF THE INVENTION

Containers for storing and transporting bakery goods and the like are typically made of a one-piece construction of a suitable plastic material and are configured for stacking of one upon another at different elevations when the containers are empty. To effect such stacking of identical containers, and the containers typically include pivotally mounted "bales" or "bale members" which function as support members for effecting mounting and support of a second of one container upon an identical container. Once a container is filled with product, the product can apply forces to the container walls, causing the container walls to flex. When pivotally mounted to the interior surface of the container walls, such as in the manner disclosed in U.S. Pat. No. 4,573,577, bale members run the risk of becoming disengaged from the walls upon such flexing. To mitigate this risk, some containers are designed with bale members mounted to the exterior surface of the container walls.

For known containers with externally mounted bale members, the exterior wall surfaces interfere with the bale member as it pivotally rotates to a position external to the container. Also, once the bale members are positioned externally of the container, the design of existing containers render it awkward to effect movement of the bale member from this position.

SUMMARY OF THE INVENTION

The present invention provides a container comprising:

a base configured to vertically support at least one object, a pair of opposed sidewalls projecting above the base and configured to retain the at least one vertically supported object on the base, each of the sidewalls having a top surface, an exterior surface, and a receptacle, wherein the exterior surface merges with the top surface to define an upper exterior edge, and wherein the exterior surface further merges with the receptacle to define a receptacle edge, and a support member pivotally mounted within the receptacles to facilitate pivotal movement of the support member relative to each of the sidewalls, the support member being configured to support a second identical container, wherein the upper exterior edge and the receptacle edge of at least one of the opposed sidewalls are configured to simultaneously oppose the support member during at least a portion of the pivotal movement such that the clearance between the support member and the upper edge is greater than the clearance between the support member and the receptacle.

In one aspect, the receptacle edge projects further outwardly relative to the upper exterior edge.

In another aspect, the top surface of at least one of the opposed sidewalls defines at least one notch for receiving the support member to effect retention of the support member at a support member rest position in the at least one notch.

In a further aspect, the support member is configured to support the base of the second identical container when the support member is received and retained by the at least one notch.

In yet another aspect, the support member includes a first portion extending across the opposed sidewalls and configured to engage the base of the second identical container to effect support of the second identical container when the first portion is received and retained by the at least one notch, an inwardly turned end received within the receptacle to facilitate pivotal movement of the support member about a pivot axis, and a crank member extending between the first portion and the inwardly turned end, wherein the upper exterior edge and the receptacle edge are configured to simultaneously oppose the crank member during at least a portion of the pivotal movement.

In another aspect, the crank member joins the first portion to the inwardly turned end, and wherein the upper exterior edge is configured to oppose a portion of the crank member extending from the first portion during at least a portion of the pivotal movement.

In a further aspect, the pivot axis is moveable relative to the container.

In yet another aspect, the present invention further comprises a pair of opposed endwalls projecting above the base and configured to retain at least one vertically supported object on the base, wherein the sidewalls and endwalls define a space configured to receive the second identical container in a fully nested position, and means for supporting the support member externally of the space such that the base of the second identical container clears the support member when the second identical container is in the fully nested position.

In another aspect, the upper exterior edge and the receptacle edge are configured to oppose the support member as the support member moves from the support member rest position in the notch to a position wherein the support member is supported by the means for supporting.

In a further aspect, the receptacle edge projects further outwardly relative to the upper exterior edge.

The present invention also provides a container comprising:

a base configured to vertically support at least one object, a first pair of opposed sidewalls projecting above the base and configured to retain the at least one vertically supported object on the base, each of the sidewalls having a top surface, an exterior surface, and a receptacle, wherein the exterior surface merges with the top surface to define an upper exterior edge, and wherein the exterior surface further merges with the receptacle to define a receptacle edge, and a support member pivotally mounted within the receptacles to facilitate pivotal movement of the support member relative to each of the sidewalls, the support member being configured to support a second identical container, wherein the support member is configured to simultaneously traverse the upper exterior edge and the receptacle edge during at least a portion of the pivotal movement such that the clearance between the support member and the upper exterior edge is greater than the clearance between the support member and the receptacle edge.

In another aspect, the receptacle edge projects further outwardly relative to the upper exterior edge.

In a further aspect, the upper exterior edge is recessed relative to the receptacle edge.

In yet another aspect, the top surface of at least one of the opposed sidewalls defines at least one notch for receiving the support member to effect retention of the support member at a support member rest position in the at least one notch.

In another aspect, the support member is configured to support the base of the second identical container when the support member is received and retained by the at least one notch.

In a further aspect, the support member includes a first portion extending across the opposed sidewalls and configured to engage the base of the second identical container to effect support of the second identical container when the first portion is received and retained by the at least one notch, an inwardly turned end received within the receptacle to facilitate pivotal movement of the support member about a pivot axis, and a crank member extending between the first portion and the inwardly turned end, wherein configured the crank member is configured to simultaneously traverse the upper exterior edge and the receptacle edge during at least a portion of the pivotal movement such that the clearance between the crank member and the upper exterior edge is greater than the clearance between the crank member and the receptacle edge.

In yet another aspect, the crank member joins the first portion to the inwardly turned end, and wherein the crank member is configured such that a first crank member portion proximate to the first portion traverses the upper exterior portion simultaneous with a second crank member portion remote from the first portion traversing the receptacle edge during at least a portion of the pivotal movement, such that the clearance between the first crank member portion and the upper exterior edge is greater than the clearance between the second crank member portion and the receptacle edge.

In another aspect, the pivot axis is moveable relative to the container.

In a further aspect, the present invention further comprises a pair of opposed endwalls projecting above the base and configured to retain at least one vertically supported object on the base, wherein the sidewalls and endwalls define a space configured to receive the second identical container in a fully nested position, and means for supporting the support member externally of the space such that the base of the second identical container clears the support member when the second identical container is in the fully nested position.

In yet another aspect, the support member is configured to simultaneously traverse the upper exterior edge and the receptacle edge as the support member moves from the support member rest position in the notch to a position wherein the support member is supported by the means for supporting.

In another aspect, the present invention further comprises a pair of opposed endwalls projecting above the base and configured to retain at least one vertically supported object on the base, wherein the sidewalls and endwalls define a space configured to receive the second identical container in a fully nested position, and means for supporting the support member externally of the space such that the base of the second identical container clears the support member when the second identical container is in the fully nested position.

The present invention also provides a container comprising:

a base configured to vertically support at least one object;

a pair of opposed sidewalls and a pair of opposed endwalls, each of the sidewalls and the endwalls projecting above the base and configured to retain the at least one vertically supported object on the base, each of the sidewalls having an exterior surface defining a receptacle, and a support member pivotally mounted within the receptacles to facilitate pivotal movement of the support member relative to each of the sidewalls, the support member configured to support a second identical container, wherein at least one of the endwalls includes a support surface configured to support the support member, the support surface including at least two notches configured to permit application of a force to the support member by fingers of a human hand when the support member is resting on the support surfaces such that the application of the force displaces the support member from the support surface.

In yet another aspect, the sidewalls and endwalls define a space configured to receive a second identical container in a fully nested position when the support member is supported on the support surface, such that the base of the second identical container clears the support member.

DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION

Figure 1:
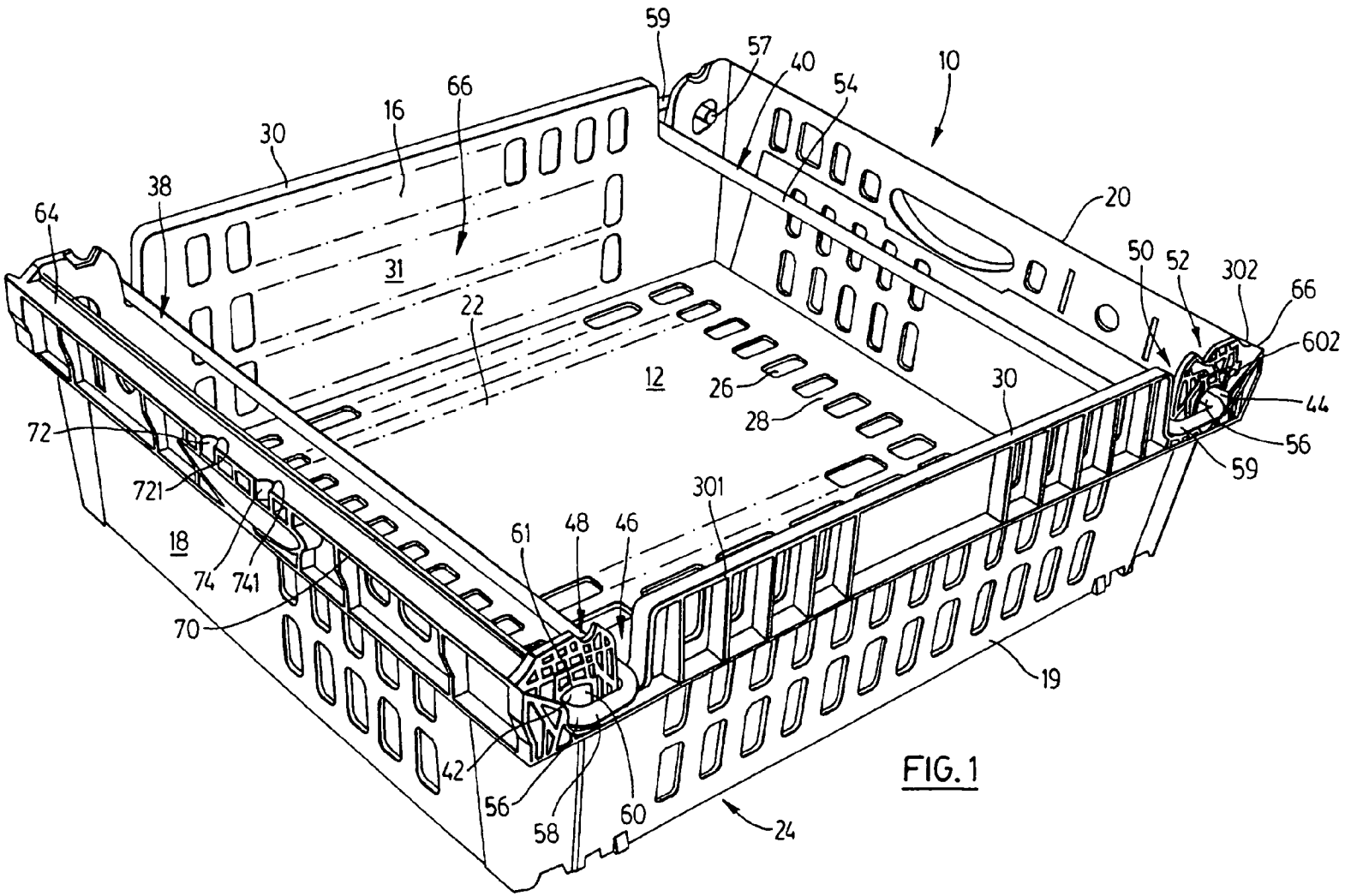
FIG. 1 is a front perspective view of an embodiment of a container of the present invention.

Referring to FIG. 1, the present invention provides a container 10 including a base 12, a first pair of opposed sidewalls 14, 16 and a second pair of opposed endwalls 18, 20. Each of the endwalls 18, 20 is joined to the sidewalls 14, 16 to define a continuous wall. The container 10 is moulded of integral one-piece construction of a suitable plastic material such as, for example, polyethylene or polypropylene.

Figure 3:
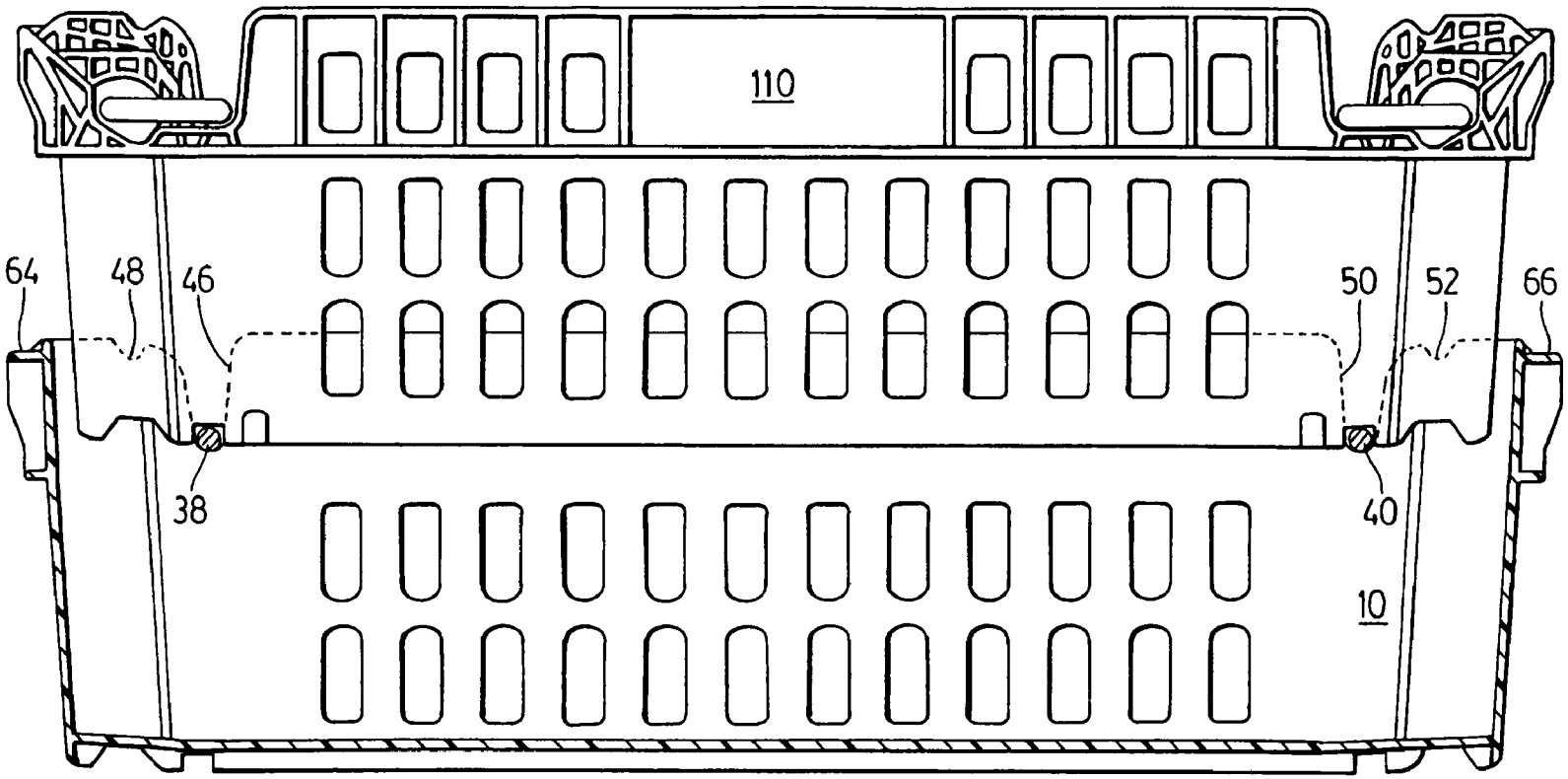
FIG. 3 is a side elevation view of the container illustrated in FIG. 1 mounted upon a second identical container out a first stacked position.
Figure 4:
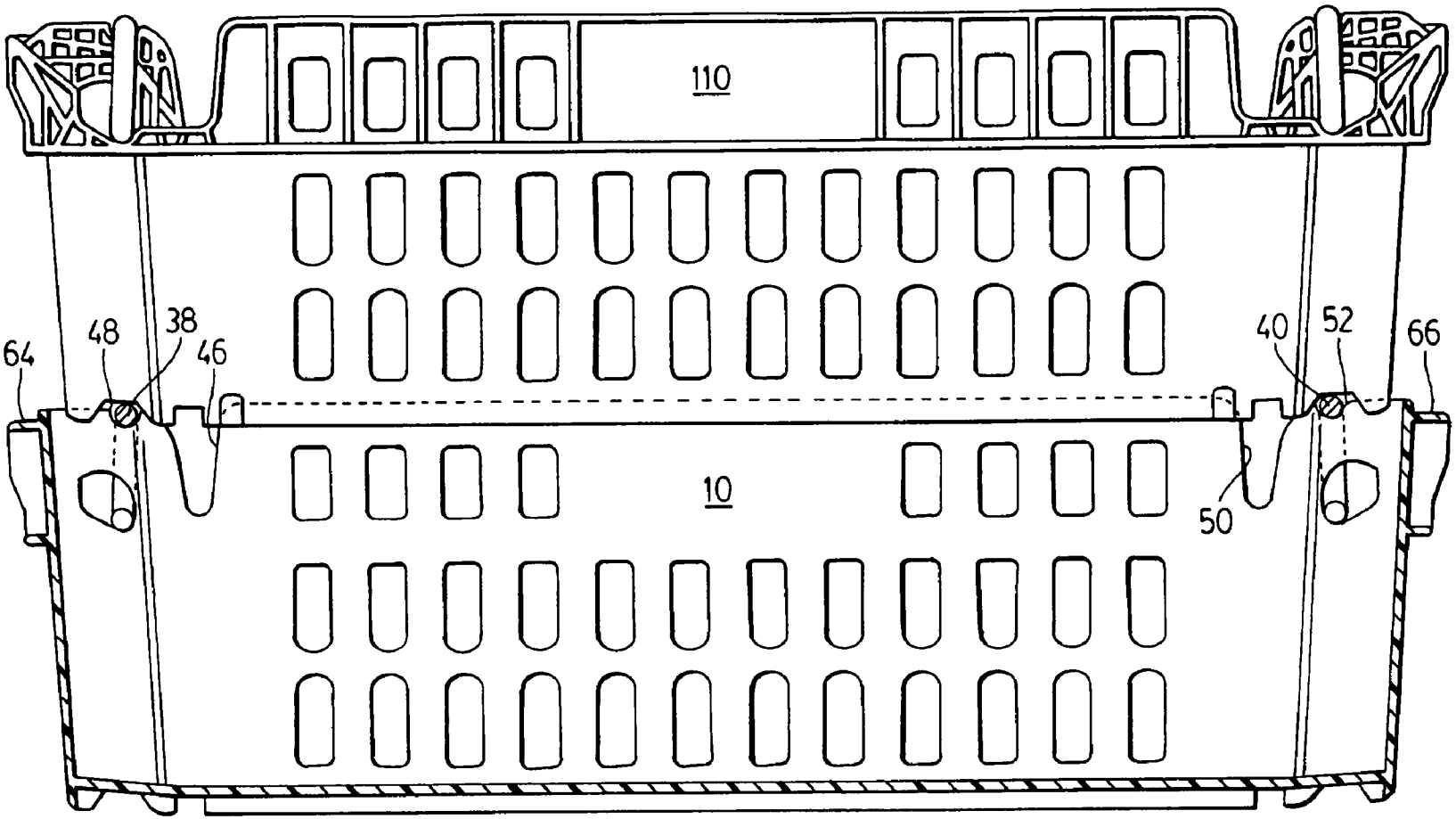
FIG. 4 is a side elevation view of the container illustrated in FIG. 1 mounted upon a second identical container at a second stacked position.
Figure 5:
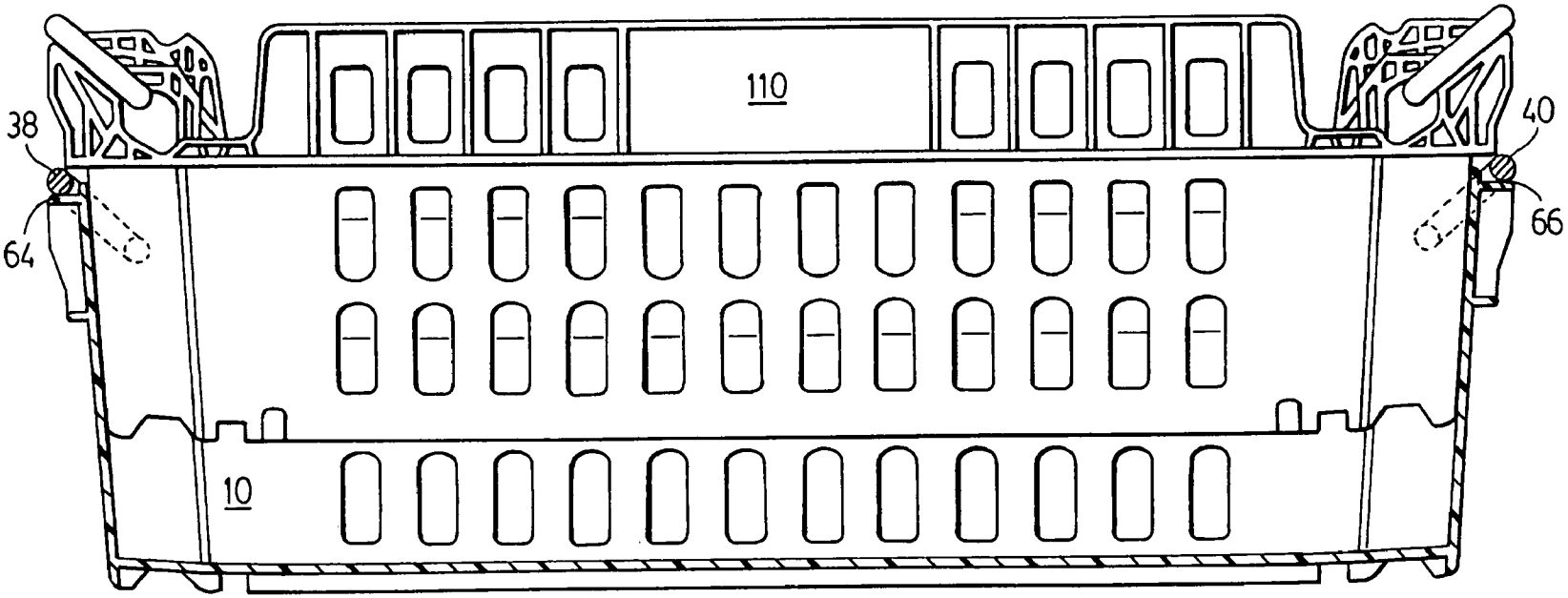
FIG. 5 is a side elevation view of the container illustrated in FIG. 1 mounted upon a second identical container in a nested position.

The container 10 is configured to facilitate mounting thereon of a second identical container 110 in the manner illustrated in FIGS. 3, 4, and 5 (a container mounted on another container in this manner is hereinafter referred to as being in a "stacked orientation"), to thereby define upper and lower containers 110, 10. Note that the second container 110 is identical in every respect to the first container 10, and that like reference numerals have been provided for like parts. It is understood that more than two containers 10 of the present invention may be mounted upon one another in the stacked orientation.

The base 12 includes an upper surface 22 and a lower surface 24. The upper surface 22 supports objects placed thereon. The lower surface 24 supports the container on a reaction surface, such as a floor. The base 12 includes a plurality of openings 26 extending from the upper surface 22 to the lower surface 24 and thereby connecting the upper surface 22 to the lower surface 24. The openings 26 are defined by a plurality of interconnected ribs 28. By including the openings 26 in the base 12, the container 10 requires less material, thereby rendering the container 10 lighter and reducing material costs.

The sidewalls 14, 16 and endwalls 18, 20 extend from and project above the base 12. The sidewalls 14, 16 and endwalls 18, 20 function as a means for retaining objects vertically supported on the base 12. In this respect, the sidewalls 14, 16 and the endwalls 18, 20 are configured to provide lateral support to objects placed on the upper surface of the base 12.

Sidewalls 14, 16 are substantially mirror images of each other. Likewise, endwalls 18, 20 are substantially mirror images of each other. In this respect, the below descriptions directed at the features of sidewall 14 and endwall 18 are equally applicable to the features of sidewall 16 and endwall 20 respectively.

Referring now to one of the pair of opposed sidewalls 14, 16. The sidewall 14 defines a top surface 30 and presents interior and exterior surfaces 31, 32. The top surface 30 merges with the exterior surface 32 at opposite ends of the sidewall 14 to define respective upper exterior edges 301, 302. Similarly, the top surface 30 merges with the interior surface 31 at opposite ends of the sidewall 14 to define respective upper interior edges 303, 304. At opposite ends of the sidewalls 14, sets of notches 46, 48 and 50, 52 of varying depths are defined in the top surface 30 and extend between and merge with the interior and exterior surfaces 31, 32, including the upper interior edges 303, 304 and upper exterior edges 301, 302. Each of the upper inner edges 303, 304, defining respective notches 46, 48 and 50, 52, is substantially horizontal thereby providing substantially the same degree of lateral support, in the vertical direction, to objects supported on the base 12 irrespective of their relative proximity to the endwalls 18, 20.

Figure 2:
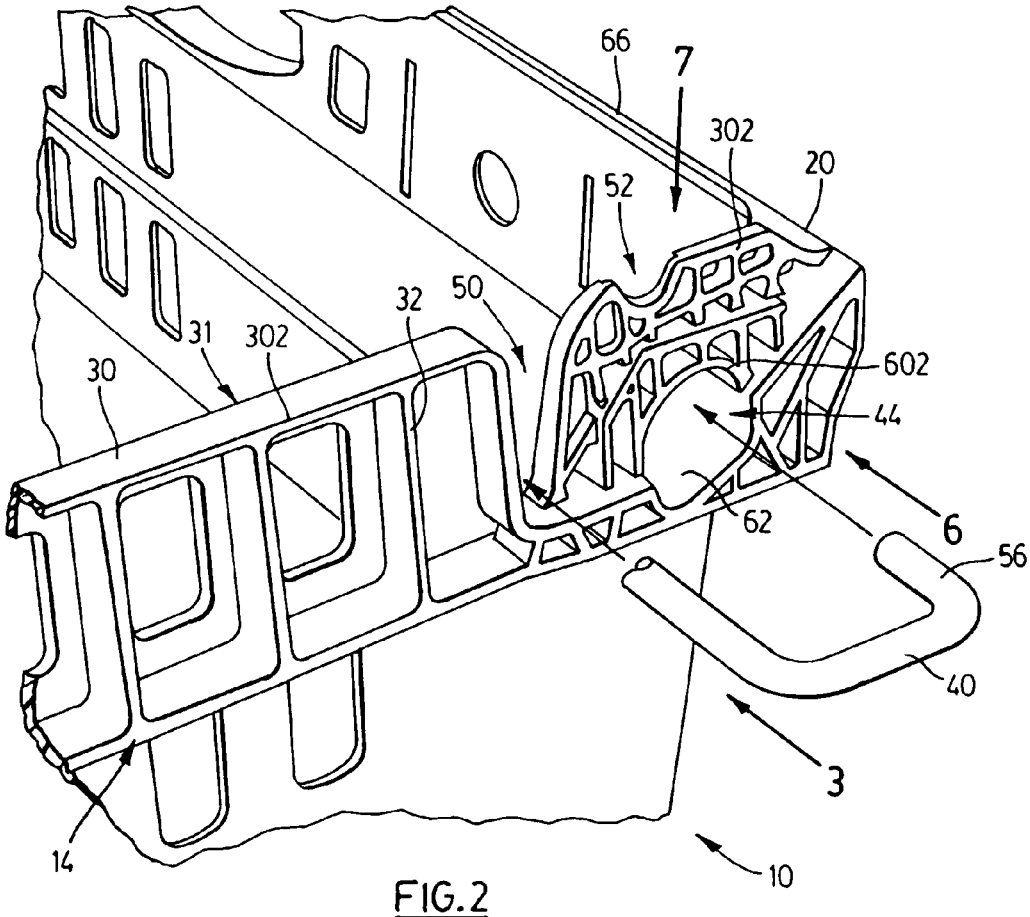
FIG. 2 is a fragmentary, exploded top perspective view of the container illustrated in FIG. 1.

Referring to FIG. 2, support members 38, 40 are pivotally mounted to the exterior surface of each the sidewalls 14, 16 at opposite ends thereof. In this respect, pivotal movement of the support members 38, 40 is facilitated relative to each of the sidewalls 14, 16. The support members 38, 40 are configured to support a second identical container 110 in the manner illustrated in FIGS. 3, 4, and 5. Receptacles 42, 44 are disposed within the exterior surface 32 of the sidewall 14 for effecting pivotal mounting of the support members 38, 40, respectively.

The notches 46, 48 and 50, 52 are configured for receiving the respective support members 38, 40. Retention of the support members 38, 40 at various support member rest positions is effected when the support members 38, 40 are received in the respective notches 46, 48 and 50, 52. When received in their respective notches 46, 48 and 50, 52, the support members 38, 40 are capable of supporting the base of a second identical container 110 (see FIGS. 3, 4, and 5).

Figure 7:
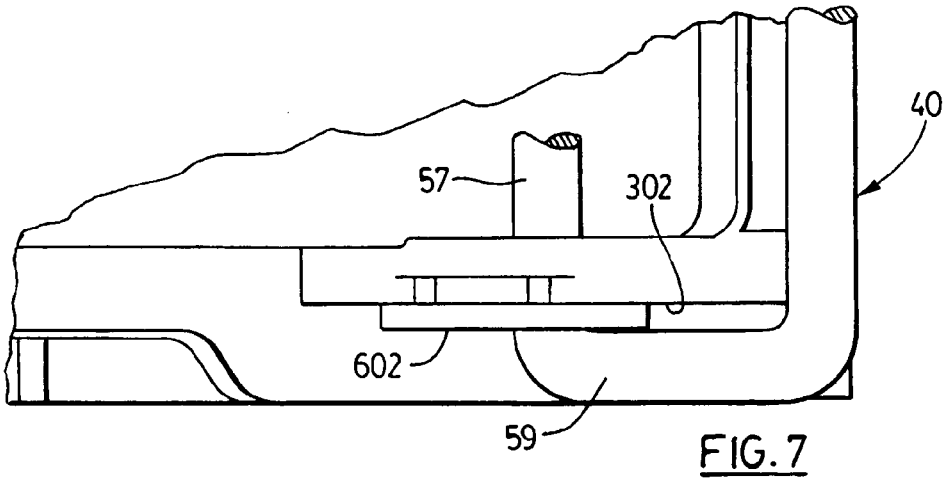
FIG. 7 is a fragmentary top plan view of the container shown in FIG. 1, illustrating the support member seated upon a support surface external to the space defined by the combination of the sidewalls and the endwalls of the container.

The receptacles 42, 44 are defined by receptacle surfaces 60, 62 which function to limit radial movement of the respective support members 38, 40 about a pivot axis within the respective receptacles 42, 44. The receptacle surfaces 60, 62 merge with the exterior surface 32 at respective receptacle edges 601, 602. Each of the receptacles 42, 44 is in the form of an aperture defined within the exterior surface 32, the aperture configured to facilitate the necessary freedom of movement of the respective inwardly turned ends 56, 57 so that the support member can move between support member rest positions in the respective notches 46, 48 and 50, 52, as well as respective positions beyond the respective endwalls 18, 20 (see FIG. 7).

The support members 38, 40 include a first engaging portion 54 in the form of a rod-like member extending across the sidewalls 14, 16, and configured to engage the base of the second identical container 110 to effect support of the second identical container 110 when the first portion 54 is received and retained by either of the respective notches 46, 48 and 50, 52. In this respect, the support members 38, 40 are commonly referred to as "bales" or "bale members". Each of the support members 38, 40 also include a pair of inwardly turned ends 56, 57 received within the respective receptacles 42, 44 to facilitate pivotal movement of the support members 38, 40 about respective moveable pivot axes. The first portion 54 is joined to the inwardly turned ends 56, 57 by respective crank members 58, 59.

Edges 301, 601 are configured to simultaneously oppose the support member 38 during at least a portion of the pivotal movement of the support member 38. Similarly, edges 302, 602 are configured to simultaneously oppose the support member 40 during at least a portion of the pivotal movement of the support member 40. In particular, during at least a portion of the pivotal movement of the support members 38, 40, the edges 301, 601 and 302, 602 oppose the respective crank members 58, 59 of the respective support members 38, 40 as the crank members 58, 59 simultaneously traverse the respective edges 301, 601 and 302, 602. The edges 601, 602 project further outwardly relative to the corresponding edges 301, 302. In this respect, the edges 301, 302 are recessed relative to the respective edges 601, 602. As a result, the clearance between the support member 38 and the edge 301 is greater than the clearance between the support member 38 and the edge 601 during the simultaneous traversal of the edges 301, 601 by the support member 38 during at least a portion of its pivotal movement. Similarly, the clearance between the support member 40 and the edge 302 is greater than the clearance between the support member 40 and the edge 602 during the simultaneous traversal of the edges 302, 602 by the support member 40 during at least a portion of the pivotal movement.

Support surfaces 64, 66 extend outwardly from and merge with the endwalls 18, 20, respectively. The support surfaces 64, 66 are configured to provide vertical support to support members 38, 40, respectively, when the support members 38, 40 are rotated beyond the endwalls 18, 20, respectively. When the support members 38, 40 are vertically supported by the surfaces 64, 66, respectively, the support members 38, 40 are said to be disposed externally of a space 68 defined between the combination of the sidewalls 14, 16 and the endwalls 18, 20 such that the space 68 is capable of receiving and supporting a second identical container in a nested position relative to the container 10 so that the base 12 of the second identical container clears the support member 38, 40 (see FIG. 7). The base 12 of the second identical container is said to clear the support members 38, 40 when the support members 38, 40 do not engage the base 12 of the second identical container when the second identical container is nested within the container 10.

Referring to the endwall 18, the support surface 64 terminates at an edge 70. The edge 70 is shaped so that, when the support member 38 is supported by (or seated on) the support surface 64, a human operator can use his or her fingers to apply forces to the support member 38 in a generally upwardly direction at spaced-apart locations along the support member 38, and preferably proximate the midpoint of the engaging portion 54 to thereby unseat or displace the support member 38 from the support surface 64. In this respect, the edge 70 defines two spaced-apart notches 72, 74. Each of the notches 72, 74 are sized so as to permit fingers from a single human hand to engage the underside of the support member 38 when the support member is seated on the support surface 64. In this respect, the notches 72, 74 are spaced apart from each other by approximately four (4) centimeters, measured between the inner edges 721, 741 of the notches 72, 74. The notches 72, 74 are disposed along the support surface 64 such that, when the support member 38 is supported on the support surface 64, the portions of the support member 38 exposed for engagement by human fingers. The respective notches 72, 74 are each disposed equal distances from the point where the engaging portion 54 merges with the respective crank members 58, 59. This facilitates application of forces substantially at the midpoint of the engaging portion 54, when forces are applied by human fingers in an upwardly direction at the notches 72, 74.

Figure 6:
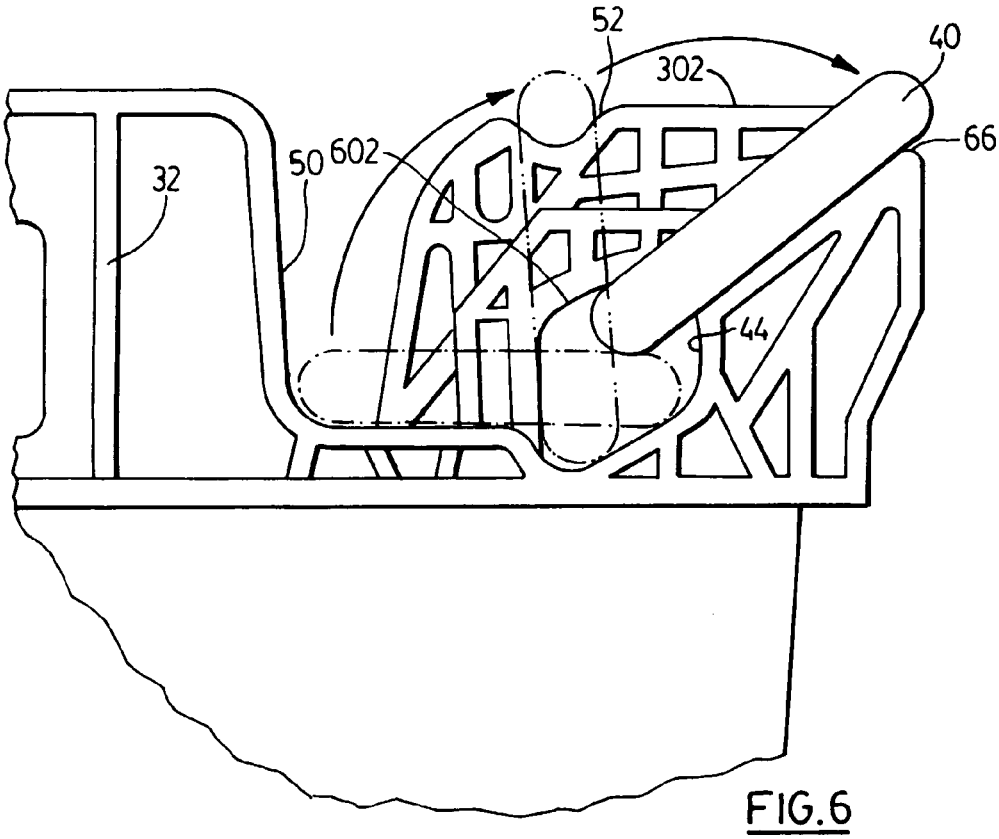
FIG. 6 is a fragmentary side elevation view of the container shown in FIG. 1, illustrating a pivotal rotation of the bale member between various support member positions.

Referring FIG. 6, the support member is illustrated in three different positions. In the first position, the support member 38 is received within the notch 46 at a first support member rest position (or a first stacking position) to facilitate support of the second identical container 110 when the second identical container 110 is received by the container 10 at a first stacked position (see FIG. 3). The support member 38 can be pivotally rotated from its first stacking position to a second stacking position, where the support member 38 is located in the notch 48. When supported in the notch 48, the support member 38 is configured to support the second identical container 110 in a second stacked position when the second identical container 110 is received by the container 10 (see FIG. 4). The support member 38 can be further pivotally rotated from its second support member rest position in the notch 48 to a position whereby the support member 38 is seated upon its support surface 64. When the support member 38 is seated upon the support surface 64, the container 10 can receive the second identical container 110 so that the second identical container 110 is in a nested position relative to the container 10 (see FIG. 5). In the nested position, the base 12 of the second identical container 110 is disposed within the space 68 defined by the sidewalls 14, 16 and the endwalls 18, 20.

Although the disclosure describes and illustrates preferred embodiments of the invention, it is to be understood that the invention is not limited to these particular embodiments. Many variations and modifications will now occur to those skilled in the art. For definition of the invention, reference is to be made to the appended claims.

The invention claimed is:

1. A container comprising:

a base configured to vertically support at least one object;

a pair of opposed sidewalls projecting above the base and configured to retain the at least one vertically supported object on the base, each of the sidewalls having a top surface, an exterior surface, and a receptacle, wherein the exterior surface meets the receptacle to define a bottom receptacle outer edge and a top receptacle outer edge, wherein the bottom receptacle outer edge is closer to the base than the top receptacle outer edge, and each of the opposed sidewalls having a support surface, a first pair of notches, and a second pair of notches provided in the top surface; and a pair of support members, each support member being pivotally mounted within the receptacles to facilitate pivotal movement of the corresponding support member relative to each of the sidewalls, each support member being configured to support a second identical container;

wherein the support surfaces of the opposed sidewalls are disposed at outer portions of the top surfaces thereof to support each of the support members in a corresponding outer position such that the container can receive a second identical container so that the second identical container is in a fully nested position relative to the container, such that the base of the second identical container clears each of the support members when the second identical container is in the fully nested position; and wherein each of the first pair of notches of each opposed sidewall is disposed respectively inward of each of said support surfaces to support the corresponding support member such that the second identical container can be received by the container at a first stacking position; and wherein each of the second pair of notches of each opposed sidewall is disposed respectively inward of each of said first pair of notches to support the corresponding support member such that the second identical container can be received by the container at a second stacking position lower than the first stacking position, each of the second pair of notches extending deeper into the opposed sidewalls with respect to the base than each of the first pair of notches, each opposed sidewall top surface extending vertically upward between each of the first pair of notches and each of the second pair of notches; and wherein the top receptacle outer edges of the opposed sidewalls are closer together than the bottom receptacle outer edges of the opposed sidewalls.

2. The container as claimed in claim 1, wherein the each support member includes a first portion extending across the opposed sidewalls and configured to engage the base of the second identical container to effect support of the second identical container when the first portion is received and retained by the corresponding notches in the opposed sidewalls, and an inwardly turned end received within the receptacle to facilitate pivotal movement of the corresponding support member about a pivot axis.

3. The container as claimed in claim 2, wherein the pivot axis is moveable relative to the container.

4. The container as claimed in claim 1, further comprising a pair of opposed endwalls projecting above the base and configured to retain at least one vertically supported object on the base, wherein the sidewalls and endwalls define a space configured to receive the second identical container in the fully nested position, and each endwall including a support surface that merges with the support surfaces of the opposed sidewalls and provides additional support to the corresponding support member in the outer position.

5. A container comprising:

a base configured to vertically support at least one object;

a first pair of opposed sidewalls projecting above the base and configured to retain the at least one vertically supported object on the base, each of the sidewalls having a top surface, an exterior surface, and a receptacle, wherein the exterior surface meets the top surface to define an upper exterior edge, and wherein the exterior surface meets the receptacle to define a bottom receptacle outer edge and a top receptacle outer edge, wherein the bottom receptacle outer edge is closer to the base than the top receptacle outer edge, and each of the opposed sidewalls having a support surface, a first pair of notches, and a second pair of notches provided in the top surface, wherein the upper exterior edge meets each of the first pair of notches to define a first notch upper exterior edge; and a pair of support members, each support member being pivotally mounted within the receptacles to facilitate pivotal movement of the corresponding support member relative to each of the sidewalls, each support member being configured to support a second identical container;

wherein the support surfaces of the opposed sidewalls are disposed at outer portions of the top surfaces thereof to support each of the support members in a corresponding outer position such that the container can receive the second identical container so that the second identical container is in a fully nested position relative to the container, such that the base of the second identical container clears each of the support members when the second identical container is in the fully nested position; and wherein each of the first pair of notches of each opposed sidewall is disposed respectively inward of each of said support surfaces to support the corresponding support member such that the second identical container can be received by the container at a first stacking position; and wherein each of the second pair of notches of each opposed sidewall is disposed respectively inward of each of said first pair of notches to support the corresponding support member such that the second identical container can be received by the container at a second stacking position closer to the base than the first stacking position, each opposed sidewall top surface extending vertically upward between each of the first pair of notches and each of the second pair of notches; and wherein the first notch upper exterior edges of the opposed sidewalls are closer together than the bottom receptacle outer edges of the opposed sidewalls.

6. The container as claimed in claim 5, wherein the bottom receptacle outer edge projects further outwardly with respect to an interior of the container than the top receptacle outer edge.

7. The container as claimed in claim 5, wherein each support member includes a first portion extending across the opposed sidewalls and configured to engage the base of the second identical container to effect support of the second identical container when the first portion is received and retained by the corresponding notches in the opposed sidewalls, and an inwardly turned end received within the receptacle to facilitate pivotal movement of the corresponding support member about a pivot axis.

8. The container as claimed in claim 7, wherein the pivot axis is moveable relative to the container.

9. The container as claimed in claim 5, further comprising a pair of opposed endwalls projecting above the base and configured to retain the at least one vertically supported object on the base, wherein the sidewalls and endwalls define a space configured to receive the second identical container in the fully nested position, and each endwall including a support surface that merges with the support surfaces of the opposed sidewalls and provides additional support to the corresponding support member in the outer position.

10. A container comprising:

a base configured to vertically support at least one object;

a pair of opposed sidewalls projecting above the base and configured to retain the at least one vertically supported object on the base, each of the sidewalls having a top surface, an exterior surface, and a receptacle, wherein the exterior surface meets the receptacle to define a bottom receptacle outer edge and a top receptacle outer edge, wherein the bottom receptacle outer edge is closer to the base than the top receptacle outer edge, and each of the opposed sidewalls having a support surface, a first pair of notches, and a second pair of notches provided in the top surface; and a pair of support members, each support member being pivotally mounted within the receptacles to facilitate pivotal movement of the corresponding support member relative to each of the sidewalls, each support member being configured to support a second identical container;

wherein the support surfaces of the opposed sidewalls are disposed at outer portions of the top surfaces thereof to support each of the support members in a corresponding outer position such that the container can receive a second identical container so that the second identical container is in a fully nested position relative to the container, such that the base of the second identical container clears each of the support members when the second identical container is in the fully nested position; and wherein each of the first pair of notches of each opposed sidewall is disposed respectively inward of said support surfaces to support the corresponding support member such that the second identical container can be received by each support member to facilitate support of the second identical container at a first stacking height above the base; and wherein each of the second pair of notches of the opposed sidewalls are disposed respectively inward of each of said first pair of notches to support the corresponding support member such that the second identical container can be received by each support member to facilitate support of the second identical container at a second stacking height above the base, wherein the first stacking height is different than the second stacking height; and wherein the top receptacle outer edges of the opposed sidewalls are closer together than the bottom receptacle outer edges of the opposed sidewalls.

11. The container as claimed in claim 10, wherein each of the bottom receptacle outer edges of the opposed sidewalls projects further outwardly with respect to an interior of the container than the first pair of notches of the opposed sidewalls.

12. The container as claimed in claim 10, wherein each of the first pair of notches is configured to receive and retain the corresponding support member at a first support member height above the base, and wherein each of the second pair of notches is configured to receive and retain the corresponding support member at a second support member height above the base, wherein the first support member height is higher than the second support member height.

13. The container as claimed in claim 12, wherein each of the first pair of notches in each of the opposed sidewalls has a first depth, and wherein each of the second pair of notches in each of the opposed sidewalls has a second depth, wherein the first depth is shallower than the second depth.

14. The container as claimed in claim 10, wherein the exterior surface of each of the opposed sidewalls defines a pair of peanut-shaped receptacles for effecting pivotal mounting of each of the support members to the exterior surface of each of the opposed sidewalls.

15. The container as claimed in claim 10, wherein each support member includes two inwardly-turned ends which pivot within the corresponding receptacles of the opposed sidewalls so that the corresponding support member spans across the opposed sidewalls, wherein each of the support member inwardly-turned ends is disposed in a corresponding one of the receptacles provided in the exterior surface of each of the opposed sidewalls, the inwardly-turned ends being moveable within the receptacles.

16. The container as claimed in claim 15, wherein each of the receptacles receives a respective one of the inwardly-turned ends to facilitate pivotal movement of the corresponding support member about a pivot axis which is moveable relative to the container.

17. The container as claimed in claim 10, wherein each of the receptacles comprises a downwardly-curved peanut-shaped slot having an upwardly extending middle portion.

18. The container as claimed in claim 10, wherein each of the receptacles is substantially circular.

19. The container as claimed in claim 10, wherein each of the receptacles is substantially circular with a bump in a lower portion thereof.

20. A three-level stacking container, comprising:

a bottom;

two end walls;

a pair of support bars, each support bar having two inwardly-turned ends;

two sidewalls, each sidewall comprising:

(i) a top edge;

(ii) a pair of ledges on the top edge;

(ii) a pair of outer notches extending downward from the top edge;

(iii) a pair of inner notches extending downward from the top edge, each inner notch extending downward from the top edge by a greater distance than any one of the outer pair of notches;

(iv) a pair or receptacles configured to contain inwardly-turned ends of the pair of support bars, each receptacle having a top outer edge and a bottom outer edge, each receptacle top outer edge being disposed in a different vertical plane than the corresponding receptacle bottom outer edge, the pair of support bars being configured to be rotatable within the sidewall receptacles so that the support bars rest in (i) the ledges so that an identical container nests within said three-level stacking container, (ii) the outer notches of opposing sidewalls so that the identical container stacks within said three-level stacking container at a first height, and (iii) the inner notches of opposing sidewalls so that the identical container stacks within said three-level stacking container at a second height lower than the first height.

21. A container, comprising:

a bottom layer;

a pair of end walls, each end wall comprising (i) a top end wall portion, (ii) an inner end wall portion, (iii) an outer end wall portion, and (iv) a support surface located on the top end wall portion;

a pair of opposing walls, each opposing wall comprising (i) a top opposing wall portion, (ii) an inner opposing wall portion, and (iii) an outer opposing wall portion, each opposing wall further comprising (iv) an outer pair of notches extending downwardly from the corresponding top opposing wall portion, and (v) an inner pair of notches extending downwardly from the corresponding top opposing wall portion, and wherein each outer opposing wall portion comprises (i) a pair of receptacles, and (ii) a recessed portion recessed inwardly from the outer opposing wall portion, each recessed portion including a top edge of the corresponding receptacle and the corresponding outer notch; and a pair of support members, each support member comprising (i) a pair of inwardly turned ends that are rotationally received within the corresponding receptacle of the opposing wall, (ii) a pair of crank members located adjacent to the inwardly turned ends, and (iii) a first engaging portion located between the pair of crank members, wherein when the first engaging portions of both support members are placed on the support surfaces of each end wall, the container is configured to stack a second identical container in nested position, the support members being configured such that (i) when the support members are placed in the inner set of notches of the opposing walls, the container is configured to stack the second identical container in a first stacking position that is higher than the nested position, and (ii) when the support members are placed in the outer set of notches of the opposing walls, the container is configured to stack the second identical container in a second stacking position that is higher than the first stacking position.

* * * * *